US005081730A

United States Patent [19]

Moody

[11] Patent Number: 5,081,730

[45] Date of Patent: Jan. 21, 1992

[54] CRIB BLANKET HOLDER

[76] Inventor: Shona Moody, 8177 Elliott St., Vancouver, B.C., Canada, V5S 2P3

[21] Appl. No.: 708,390

[22] Filed: May 31, 1991

[51] Int. Cl.[5] ..... A47G 9/04; A47D 15/02

[52] U.S. Cl. ..... 5/508; 5/498; 24/72.5; 24/499; 24/457

[58] Field of Search ..... 5/496, 498, 508, 43.1; 24/72.5, 499, 457

[56] References Cited

U.S. PATENT DOCUMENTS

| | | | |
|---|---|---|---|
| 597,805 | 1/1898 | Lownes . | |
| 1,402,796 | 1/1922 | Rodkey | 5/498 |
| 2,129,487 | 9/1938 | Bleier . | |
| 2,492,559 | 12/1949 | Dixon . | |
| 2,637,047 | 5/1953 | Zurzolo . | |
| 2,772,460 | 12/1956 | Berkowicz et al. | 24/72.5 |
| 3,616,497 | 11/1971 | Esposito, Jr. | 24/72.5 |
| 3,737,955 | 6/1973 | Hakim | 24/72.5 |

FOREIGN PATENT DOCUMENTS

| | | | |
|---|---|---|---|
| 567536 | 12/1958 | Canada | 5/498 |
| 257734 | 9/1926 | United Kingdom | 24/72.5 |

*Primary Examiner*—Alexander Grosz

*Attorney, Agent, or Firm*—Shlesinger, Arkwright & Garvey

[57] ABSTRACT

A crib blanket holder which includes a pair of opposed rigid lever arms, a fulcrum means affixed to the lever arms to provide for pivoting of the latter, the fulcrum means dividing the arms into jaws and handle regions, a pair of opposed crib post recesses in each of the lever arms so as to receive adjacent crib posts therein when the arms are disposed horizontally, and biasing means for biasing the arms so as to close the jaws together. The arms are movable in response to force manually applied to the handle regions to open the jaws and receive a blanket edge therebetween and cause the jaws to close on and clamp the blanket edge when the force is removed.

10 Claims, 3 Drawing Sheets

CRIB BLANKET HOLDER

BACKGROUND

The present invention relates to a crib blanket holder which locks onto adjacent crib posts and clamps an edge of a crib blanket. Utilizing four such holders proximate the four corners of a crib blanket allows the blanket to be held in a position so that an infant is unable to move the blanket when rolling over.

Early blanket holding devices include U.S. Pat. No. 2,637,047 issued May 5, 1953 to Zurzolo which discloses a padded elongated side boards clamped to the crib posts on either side of the bed. A pair of slide fastener strips stitched onto either side of a blanket are used in combination with a set of fasteners to attach the blanket to the side boards. Clearly special fastener strips for attachment to a blanket as well as special side boards and fasteners interconnecting the fastener strips and side boards presents a complex solution to holding the crib blanket.

A simple bed clothes clamp which attaches to a rail with a slot and clamping screw passing into the slot is disclosed by U.S. Pat. No. 597,805 issued Jan. 25, 1898 to L. M. Lownes. However, the method of securing the clamp to the bed frame is unreliable as the clamping screw is prone to work loose.

There are a line of patents which disclose rings openable to enclose a crib post and adapted to attach to an edge or corner of a crib post. These include U.S. Pat. No. 2,492,559 issued Dec. 27, 1949 to Dixon which discloses an elongated strip element formed into opposed L-shapes with the top of the L's joined by a U-shaped portion to form a closed structure having a slit where the L's abut. The frame is first installed onto a crib post by bending the L-shaped sections apart at the slit. Next a clamping bar is installed onto the frame and finally a blanket corner is looped under and over the clamping bar and then returned under the frame.

Both Canadian Patent No. 567,536 issued Dec. 16, 1958 to Turner and U.S. Pat. No. 3,737,955 issued June 12, 1973 issued to Hakim disclose a split ring for enclosing a crib post and a safety pin device affixed to the ring and attachable to the blanket.

U.S. Pat. No. 2,129,487 discloses a split ring for engaging a crib post and a fastener attached to the ring and engageable with a fastening strip affixed to either side of the blanket.

A somewhat less complex device than any of the above is that disclosed in U.S. Pat. No. 2,772,460 issued Dec. 4, 1956 to Berkowicz et al. which consists of a belt and loop which loops around a horizontal rod affixed to either side of the crib and has a clamping buckle on the other end of the strap for attachment to an edge of a blanket. The manner of looping the belt around a crib post does not lend itself to vertical adjustment of the position of the belt on the crib post so as to slightly raise the blanket and allow air circulation under the blanket.

Finally, U.S. Pat. No. 3,616,497 issued to Esposito, Jr. discloses a clamping instrument having a resilient C-grip which snaps onto a guard rail and has separable jaws which receive and retain a bed cover. However, since the clamping jaws and the C-grip are in the same plane a horizontal rod or post is required in order to clamp the bed cover without deforming the latter. Accordingly, there is no way of adjusting the vertical position of the clamping unless regularly spaced horizontal bars were provided on either side of the bed.

Another difficulty is that the clamp must be affixed to the rod or post first and then opened to engage the blanket. This means that a user must use one hand to open the jaws of the device and another to bring an edge of the blanket between the jaws.

Accordingly, it is an object of the invention to provide an improved crib blanket holder. It is a further object to provide a crib blanket holder that engages the crib posts and is capable of continuous vertical adjustment thereon. It is yet a further object of the invention to provide a crib blanket holder that is easily engageable and disengageable with the crib posts.

SUMMARY OF THE INVENTION

According to the invention there is provided a crib blanket holder which includes a pair of opposed rigid lever arms, fulcrum means affixed to the lever arms to provide for pivoting of the lever arms thereabout, the fulcrum means dividing the arms into jaw regions and handle regions. A pair of opposed crib post recesses are formed in each of the lever arms so as to received adjacent crib posts therein when the arms are disposed horizontally. Biasing means biases the arms so as to close the jaw regions together. However, the arms are movable in response to force manually applied to the handle regions to open the jaws and receive a blanket edge therebetween and to close and clamp the blanket edge when the force is removed.

Preferably, the crib post recesses are located in the handle portion adjacent the fulcrum means and are lined with an elastomeric material to accommodate variations in the cross-section of the crib post and to prevent the holder from slipping vertically when in place.

Advantageously, the arms are wider than the width between adjacent crib posts.

By the simple process of first opening the jaws of the holder to grip a blanket edge, orienting the holder vertically, backing it through the space between adjacent crib posts and then rotating it horizontally so that the crib posts enter the crib post recesses at a desired height, the entire procedure can be accomplished using only one hand. Allowing for vertical height adjustment enables a user to adjust the blanket to provide for air circulation as well as to prevent it from being entangled with a child when the child turns over from one side to another.

BRIEF DESCRIPTION OF THE DRAWINGS

The novel features believed characteristic of the invention are set forth in the appended claims. The invention itself, as well as other features and advantages thereof, will be best understood by reference to the description which follows read in conjunction with the accompanying drawings, wherein:

DETAILED DESCRIPTION WITH REFERENCE TO THE DRAWINGS

Figure 1:
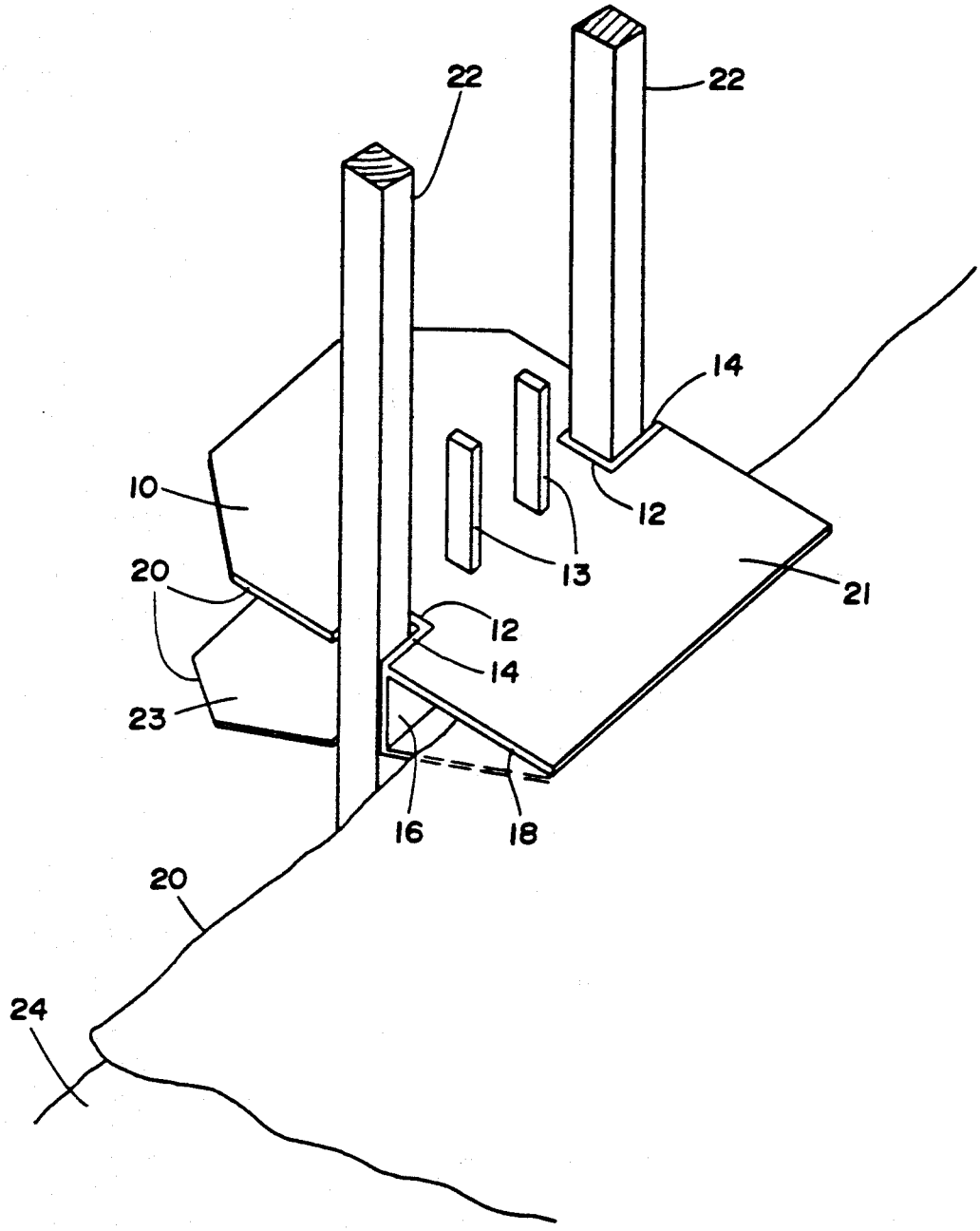
FIG. 1 is a perspective view of a preferred embodiment of the invention shown installed between adjacent crib posts of a crib and clamping a crib blanket.

Referring to FIG. 1 there is shown a crib blanket holder 10 consisting of two opposed panels or arms 21 and 23 joined by a transverse, flexible, elongated fulcrum plate 16 intermediate the panels 21 and 23, dividing the panels 21 and 23 into opposed jaws 18 and opposed handle portions 20. A pair of opposed crib recesses 12 are formed on each panel 21 and 23 toward handle portions 20 and adjacent fulcrum plate 16. The crib recesses are lined with an elastomeric material 14 such as foam. A pair of protruding prongs 13 provided on panel 21 are spaced apart so as to tightly pass over a crib post 22 for attachment thereto for storage as shown in FIG. 2.

Figure 3:
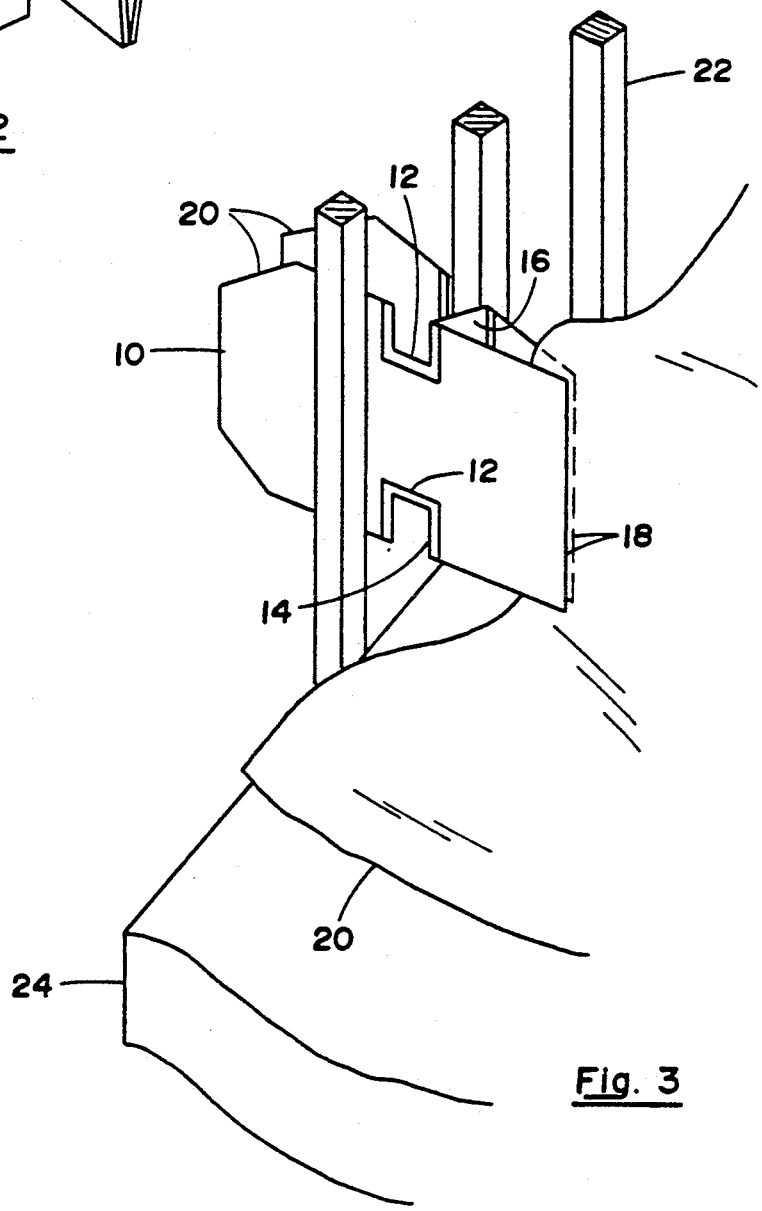
FIG. 3 is a perspective view showing the manner in which the holder is backed between adjacent crib posts to a location at which it is rotated to a horizontal position and the crib post recesses in the holder receive the crib posts.

In operation as shown in FIG. 3, the jaws 18 of the holder 10 are first opened by manually depressing handles 20, slipping the jaws 18 over an edge of a blanket and then releasing the handles 20 so that jaws 18 firmly retain the blanket. The holder 10 is then oriented in a vertical position and backed through the space between adjacent crib posts at the desired elevation. The holder 10 is then oriented to a horizontal position so that recesses 12 receive posts 22 and lock the holder 10 against movement through the posts 22. The elastomeric lining 14 around the crib post recesses 12 prevents the holder 10 from slipping vertically once in place.

Figure 4:
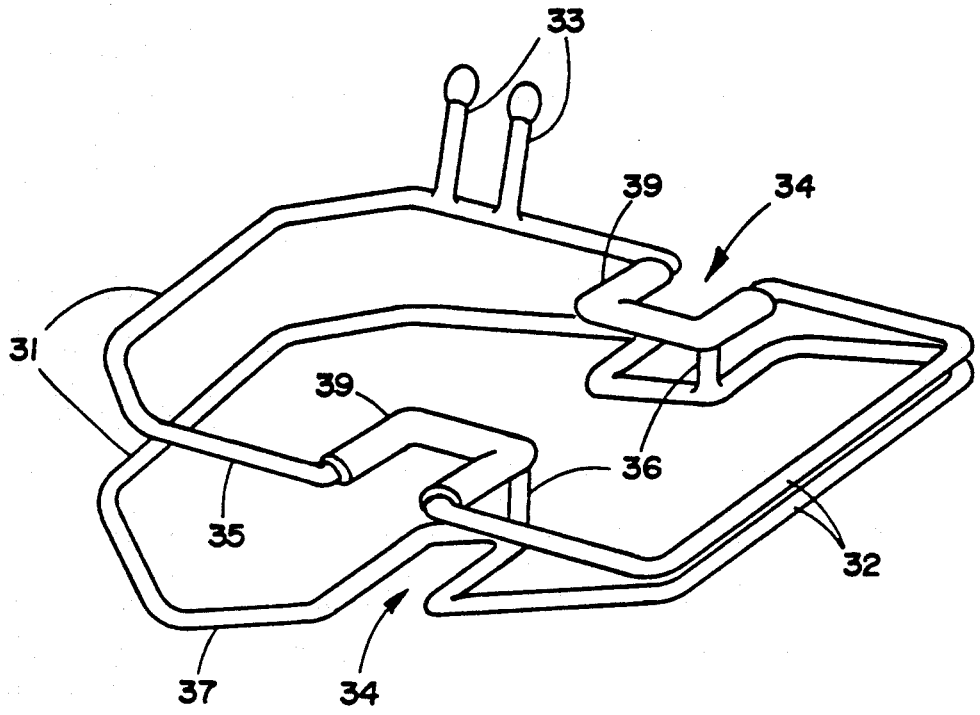
FIG. 4 is an alternative embodiment of the invention utilizing a framework of rod for each lever arm with a biasing element on either side of the holder joining each lever arm and toward the handle end of the crib post recesses.

Referring to FIG. 4 there is shown an alternative holder 30 in the form of a framework of stiff round steel wire consisting of opposed arms 35 and 37 joined by flexible fulcrum bars 36 which divide a handle portions 31 from jaw portions 32. The frame is fabricated so that the arms 35 and 37 are biased to close jaws 32. Adjacent the fulcrum bars toward the handle portion are a pair of opposed crib post recesses 34 on each of arms 35 and 37. An elastomeric sleeve 39 is formed on the crib post recesses 34 on arm 35 to provide a non-slip surface. A pair of prongs 33 are provided on arm 35 to engage a crib post for storage.

Figure 2:
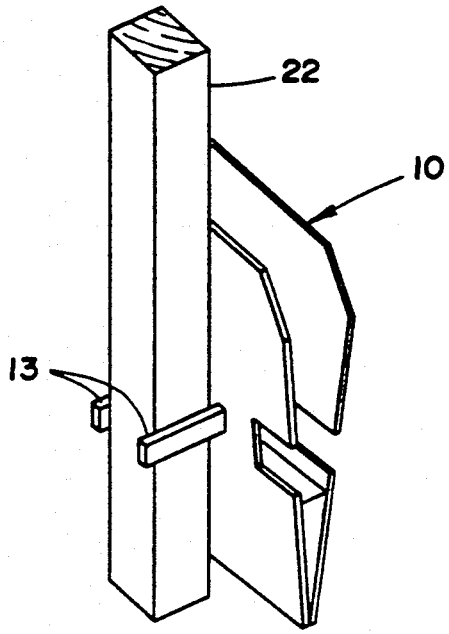
FIG. 2 is perspective view showing the manner in which the holder is stored by being clipped onto a crib post.

The operation of retaining a crib blanket 20 (see FIG. 1) with holder 30 is the same as that for the holder 10 of FIGS. 1 to 3.

Figure 5:
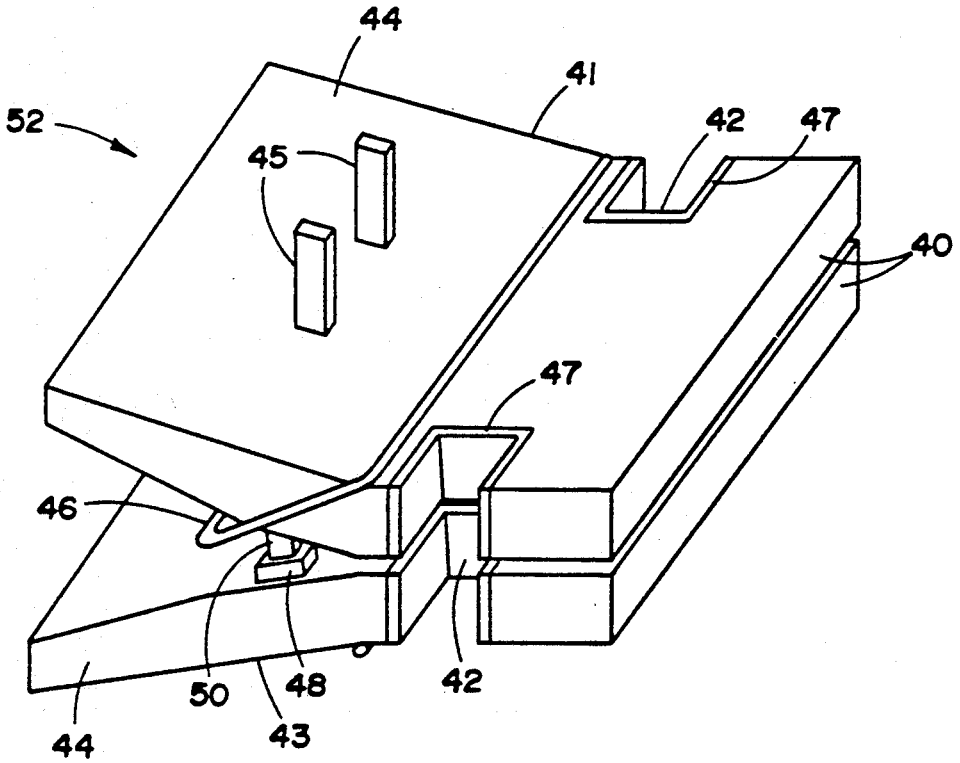
FIG. 5 is yet another embodiment showing a separate spring element and crib post recesses in the jaw element.

A second variant 52 of the holder 10 of FIG. 1 is shown in FIG. 5. In this case opposed arms 41 and 43 pivot about a pair of fulcrum studs 50 affixed to arm 41 on either side thereof and loosely insertable into fulcrum receptacles 48 affixed to corresponding sides of arm 43. Each of arms 41 and 43 has a handle 44 and jaw 40 on opposite sides of the fulcrum studs 50 and receptacles 48. A crib post recess 42 is formed on each side of each arm 41 and 43 in the jaw 40 to receive a crib post therein. An elastomeric lining 47 is affixed to an inside of the recesses 42 so as to snugly grip the crib post 22 when inserted therein and prevent slippage. A retainer spring 46 holds the arms 41 and 43 together and biases the jaws 40 together. A pair of prongs 45 on arm 41 are used to engage a crib post 22 and store the holder 52.

Again in operation the jaws 40 of the holder 52 are opened to grip a blanket edge 20 and then slid through the space between the crib posts 22 (see FIG. 1) and rotated to cause the crib posts 22 to be inserted into the crib recesses 42. Prongs 45 are pushed over a crib post 22 for storage of the holder 52 when not in use.

Other variants are clearly possible such as, for example, making the arms narrower than the space between the crib posts and the crib post recesses projecting out from the sides of the arms. Moreover, other forms of biasing the arm so that the jaws are normally closed are also clearly possible such as by using coil springs or leaf springs. Although foam has been indicated as a preferred elastomeric material for lining the crib post recesses, other forms of such material are possible such as rubber and neoprene.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A crib blanket holder, comprising:
(a) a pair of opposed rigid lever arms;
(b) fulcrum means affixed to said lever arms to provide for pivoting of said lever arms, said fulcrum means dividing said arms into jaws and handle regions;
(c) a pair of opposed crib post recesses in each of said lever arms so as to frictionally receive adjacent crib posts therein when said arms are disposed horizontally, said recesses permitting the vertical adjustment of the crib blanket holder relative to the two cooperating, adjacent crib posts; and
(d) biasing means for biasing said arms so as to close said jaws together;
wherein said arms are movable in response to force manually applied to said handle regions to open said jaws and receive a blanket edge therebetween and cause said jaws to close on and clamp said blanket edge when said force is removed.

2. A holder according to claim 1, wherein said crib post recesses are in said handle region adjacent said fulcrum means.

3. A holder according to claim 1, wherein said crib post recesses are in said jaws adjacent said fulcrum means.

4. A holder according to claim 1, 2, or 3 wherein said crib post recesses are lined with an elastomeric material.

5. A holder according to claim 1, wherein said biasing means and said fulcrum means are integral with said arms.

6. A holder according to claim 5, wherein said biasing means and said fulcrum means are both a flexible frame between and substantially transverse to said arms.

7. A holder according to claim 5, wherein said biasing means and said fulcrum means are both a flexible elongated plate intermediate and transverse to said arms.

8. A holder according to claim 1, wherein said fulcrum means is a pair of pivot arms projecting from either side of one of said arms and a pair of corresponding opposed pivot receptacles on either side of another of said arms, said pivot arms loosely insertable into said pivot receptacles intermediate said arms.

9. A holder according to claim including means for affixing said holder to a crib post for storage of said holder.

10. A holder according to claim 9, wherein said affixing means includes a pair of prongs on one of said arms spaced apart so as to fit snugly around a crib post.

* * * * *